US010336537B1

(12) United States Patent
Scott

(10) Patent No.: US 10,336,537 B1
(45) Date of Patent: Jul. 2, 2019

(54) LEAF LIFTER AND METHOD OF USE

(71) Applicant: Mark E Scott, Denver, CO (US)

(72) Inventor: Mark E Scott, Denver, CO (US)

( * ) Notice: Subject to any disclaimer, the term of this patent is extended or adjusted under 35 U.S.C. 154(b) by 0 days.

(21) Appl. No.: 15/846,826

(22) Filed: Dec. 19, 2017

(51) Int. Cl.
*B65F 1/14* (2006.01)
*B65F 5/00* (2006.01)

(52) U.S. Cl.
CPC ..... *B65F 1/14* (2013.01); *B65F 2240/138* (2013.01)

(58) Field of Classification Search
CPC ..... B65F 1/14; B65F 2240/138; A01G 20/30; A01G 20/43
USPC ..... 294/209, 152, 214
See application file for complete search history.

(56) References Cited

U.S. PATENT DOCUMENTS 2,564,907 A * 8/1951 Krummel, Jr. ..... A47L 13/52 56/400.1
2,749,695 A * 6/1956 Hoopingarner ..... A01G 20/30 15/257.6
4,296,788 A 10/1981 Slater
4,693,504 A * 9/1987 Baker ..... A01G 20/30 294/219
5,524,423 A 6/1996 Haley
7,093,867 B2 * 8/2006 Yardley ..... A01G 20/30 294/214
7,249,792 B1 * 7/2007 Bunten ..... B65F 1/00 294/152
8,181,569 B1 * 5/2012 Lewandowski ..... B30B 9/301 100/102
9,422,107 B1 * 8/2016 Sigety ..... B65F 1/0006
2004/0212201 A1 * 10/2004 Esposito ..... B65F 1/00 294/214
2006/0232082 A1 * 10/2006 Tiura ..... B65F 1/00 294/214

* cited by examiner

*Primary Examiner* — Dean J Kramer
(74) *Attorney, Agent, or Firm* — Leyendecker & Lemire, LLC

(57) ABSTRACT

A device and associated method for lifting leaves from a pile in larger quantities that is traditionally possible using a shovel or rake is described. Broadly, the device comprises a plastic or fabric flexible rectangular sheet having at least a pair of parallel elongated rods affixed to opposing sides of the sheet. At least some embodiments further include an elongated handle, often in the form of a rod, connected with and extending outwardly from one of the elongated rods.

5 Claims, 5 Drawing Sheets

LEAF LIFTER AND METHOD OF USE

BACKGROUND

Each fall deciduous trees lose their leaves. causing the leaves to accumulate on lawns and other landscaped ground surfaces. If left and not cleaned up, the leaves are not only unsightly especially when they become water-logged and begin to rot but they can also damage the underlying grass. Accordingly, it is relatively common practice to gather the leaves, typically by raking, into piles. The piles are then scooped up and placed into trash receptacles of plastic bags for disposal.

Traditionally, leaves are picked up with a shovel or rake from a large pile and deposited in a garbage can or plastic bag. The amount of leaves that can be picked up at once is typically very limited and getting substantially all the leaves from a shovelful or rake full into the bag or can be challenging. For large piles of leaves the entire process can be arduous and time consuming.

DETAILED DESCRIPTION

Figure 1:
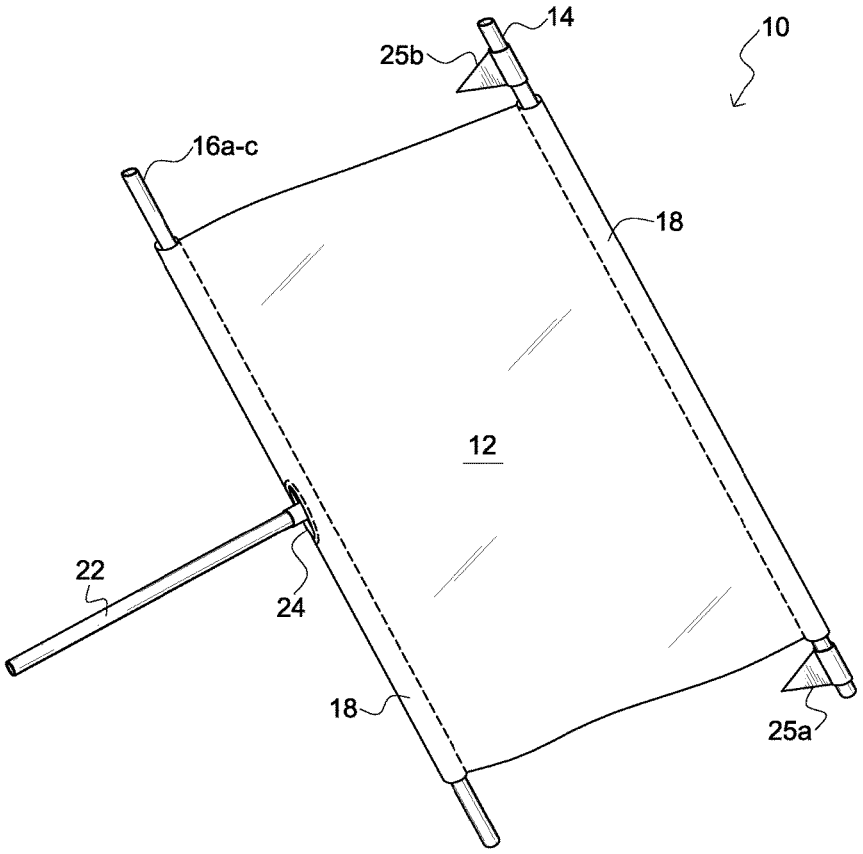
FIG. 1 is a top perspective view of a leaf lifter according to one embodiment of the present invention.

Embodiments of the invention comprise a device and associated method for lifting leaves from a pile in larger quantities that is traditionally possible using a shovel or rake. Broadly, the device comprises a plastic or fabric flexible rectangular sheet having at least a pair of parallel elongated rods affixed to opposing sides of the sheet. At least some embodiments further include an elongated handle, often in the form of a rod, connected with and extending outwardly from one of the elongated rods.

In use, a person first creates piles of leaves using traditional means, such as raking. An embodiment of the device is then placed over and on top of the leaves with at least one of the sides having an elongated rod attached thereto typically positioned near an edge of the pile. Using one or both rods, the sides of the sheet are pushed into and around the pile of leaves. If the embodiment is equipped with a elongated handle, the side having the handle can be pushed down and under the leaves in the direction of the other rod using the handle to manipulate the side. Once the side with the elongated rods are positioned close or next to each other, the user typically straddles the encapsulated pile of leaves and lifts the device holding the sides together. The leaf laden device is then carried over to a receptacle and situated vertically above the receptacle and manipulated to get the leaves to fall into the receptacle.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Leaf Lifting Device

Figure 2:
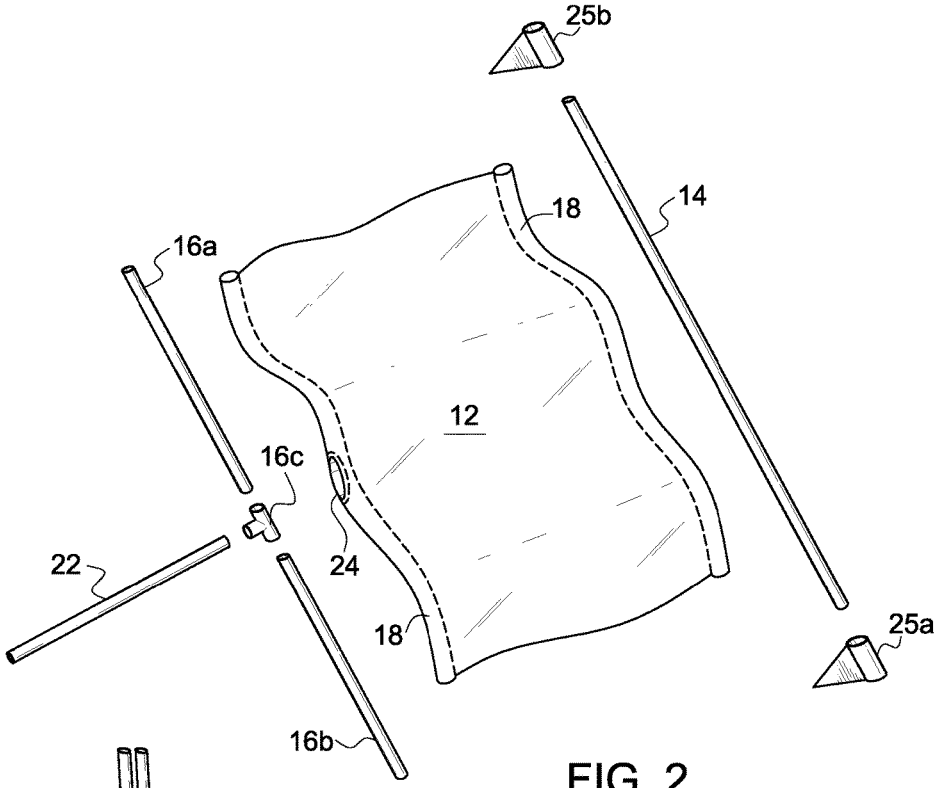
FIG. 2 is an exploded view of the leaf lifter according to one embodiment of the present invention.
Figure 3:
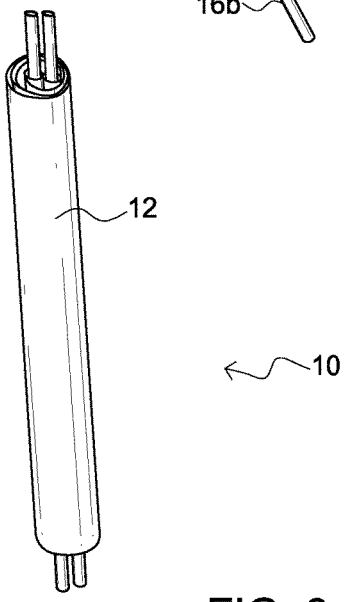
FIG. 3 is a perspective view of the leaf lifter rolled up into a storage configuration according to one embodiment of the present invention.

An embodiment of a leaf lifting device is illustrated in FIGS. 1-3. The embodiment comprises: (1) a flexible fabric or plastic film sheet 12; (2) a right elongated rod 14 extending at least substantially the entire length of a right side of the sheet and being coupled to the sheet proximate the right side edge; (3) a left elongated rod assembly 16*a-c* extending at least substantially the entire length of a left side of the sheet and being coupled to the sheet proximate the left side edge; and an elongated handle rod 22 extending from the left rod assembly proximate a midpoint of the left elongated rod assembly. At least some embodiments further include a pair of ground stakes 25*a*&*b* received on to the ends of the right elongated rod.

The flexible fabric or plastic sheet 12 can be comprised of any suitable material that provides sufficient strength against rips and tears as it is dragged along leaves, associated twigs and the underlying ground. In one variation, the sheet comprises 2-5 mil thick polyethylene sheeting. In another variation, the sheet comprises a spun non-woven fabric, such as Tyvex®. In other variations, the sheet comprises a polypropylene or nylon fabric. Other variations comprise a coated rip stop fabric. In some variations the sheet can be water resistant while in others it can be breathable.

As shown the edges of the left and right sides of the sheet are formed into tubular sleeves 18. the sleeves are configured to receive the elongated rods 14 & 16*a-c* therein. About midway along the left side tubular sleeve an opening 24 is provided permitting access to the left elongated rod assembly 16*a-c* to couple the elongated handle rod 22 thereto.

The right elongated rod and the top and bottom pieces of the left elongated rod assembly 16*a*&*b* typically comprise suitable cylindrical or tubular stock that is substantially rigid. In at least one variation the elongated rods can comprise wood shafts. In another variation, the elongated rods can comprise ¾" to 1.0" schedule 40 or 80 PVC pipe.

In yet other variations, the elongated rods can comprise steel, copper or aluminum tubing.

The left elongated tubular rod assembly comprises the top and bottom elongated pieces 16*a*&*b* and a centrally located T-connector 16*c*. The inside ends of each piece are fixedly or removably secured to the T-connector. The leg of the T-connector extends outwardly of the sleeve through the provided opening 24 in the left side tubular sleeve 18.

When PVC pipe is utilized, a PVC T-connector can be utilized as well. The top and bottom elongated pieces 16*a*&*b* can be solvent welded to the T-connector 16*c*. The elongated handle rod 22, which can be comprised of similar materials as the elongated rods, can be either solvent welded into the T-connector's leg or interference fit to permit removal for more compact storage. The elongated handle is typically 1-4 feet in length, more preferably 1.5-3.5 feet in length and most preferably 2-3 feet in length. In other variations, The leg of the T-connector can be threaded as can the corresponding end of the elongated handle rod to permit a removable threaded connection. In yet another variation the left elongated rod comprises a elongated single rod or tube with a hole, typically threaded, extending into the rod proximate its center wherein the elongated handle rod can be received. As can be appreciated, numerous other means of connecting the handle rod with the left elongated rod assembly are contemplated as would be obvious to one of ordinary skill in the field to which the invention pertains given the benefit of this disclosure.

The optional ground stakes 25*a*&*b* typically include cylindrical portions that can be slid onto the ends of the right elongated rod 14 and include protecting portions configured to be staked into the ground. The stakes can be made of any suitable material including plastic and metal.

FIG. 3 illustrates the leaf lifting device in a compact configuration for storing the device. Typically, the elongated handle rod 22 is removed from the left elongated rod assembly 16*a-c* and placed parallel and next to the left elongated rod assembly. The sheet is then rolled up. The device can then be stored against a wall or at the back of a shelf without taking up much space.

A Method of Using an Embodiment of a Leaf Lifting Device

Figure 4A:
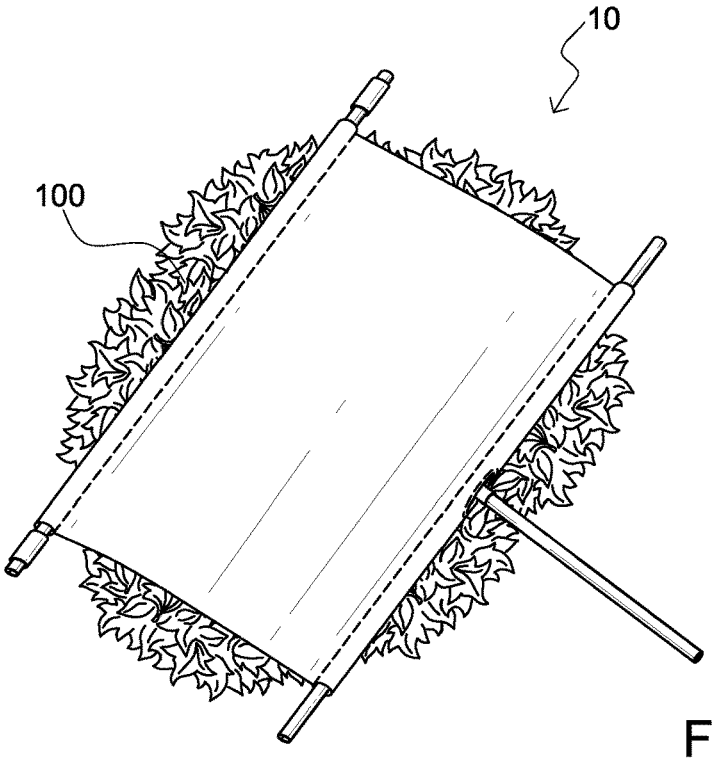
FIGS. 4*a-e* illustrate the use of the leaf lifter to pick up and deposit leaves in a receptacle according to one embodiment of the present invention.
Figure 4B:
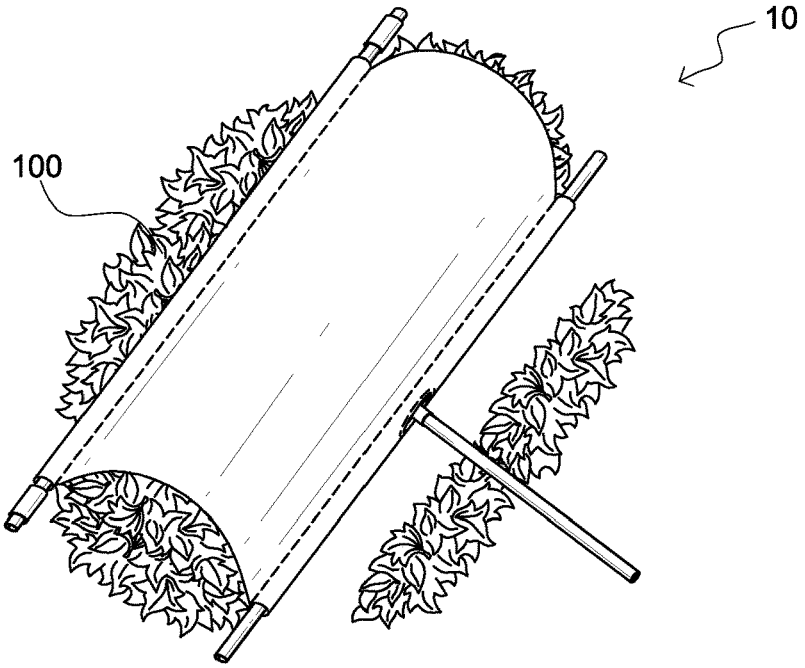
Figure 4C:
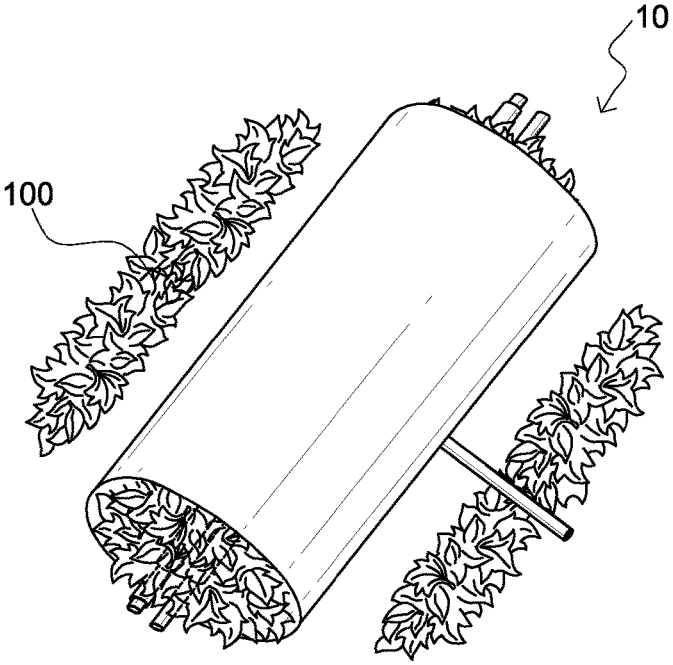

A method of using an embodiment of the leaf lifting device 10 is described with reference to FIGS. 4*a-e*. Initially, leaves are gathered into a pile 100 typically through raking. The device is unrolled and placed over the top of the pile of leaves. Typically, although not necessarily, the left edge (as described above) of the device having the elongated handle is placed near an edge of the pile. If so equipped, the stakes 25*a*&*b* are pressed into the ground to secure the right elongated rod 14 in place Next as shown in FIG. 4*b*, the user pushes the elongated handle 22 and the corresponding edge into the pile towards the ground and towards the opposing edge of the device essentially encapsulating leaves in the flexible sheet 12. FIG. 4*c* shows the device with a relatively large quantity of leaves contained in it after they have been scooped up. In variations that do not have the handle, the user can push one edge towards the other by placing one or both hands around the associated elongated rod 14. Alternatively, the user can straddle the device, lean over and place one hand around the left rod 16*a-c* and the other hand around the right rod 14 and then push each rod downwardly and towards the other to scoop up leaves.

Figure 4D:
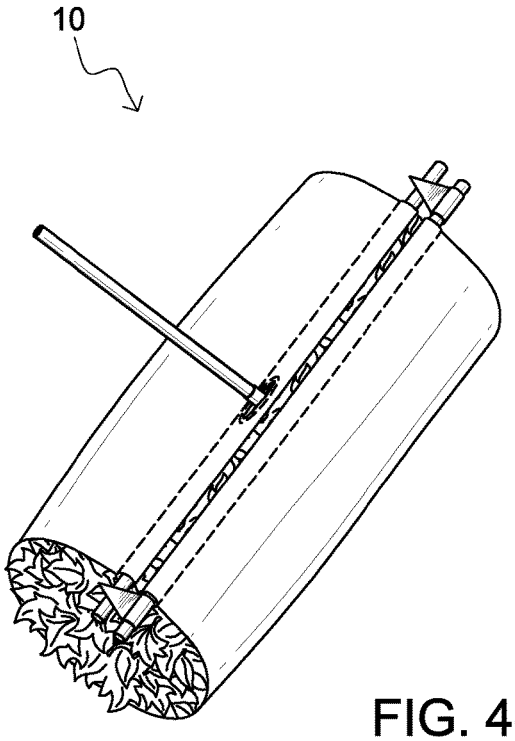

The user then flips over the bundle of leaves contained in the device as shown in FIG. 4*d* for transport and disposal. As necessary, the stakes 25*a*&*b* are pulled from the ground. All the while the user holds the left and right elongated rods and the associated edges of the device together to effectively contain the leaves and prevent them from falling out. As can be appreciated, the bundle is carried with its longitudinal axis held generally horizontally to prevent leaves from falling out of either open end.

Figure 4E:
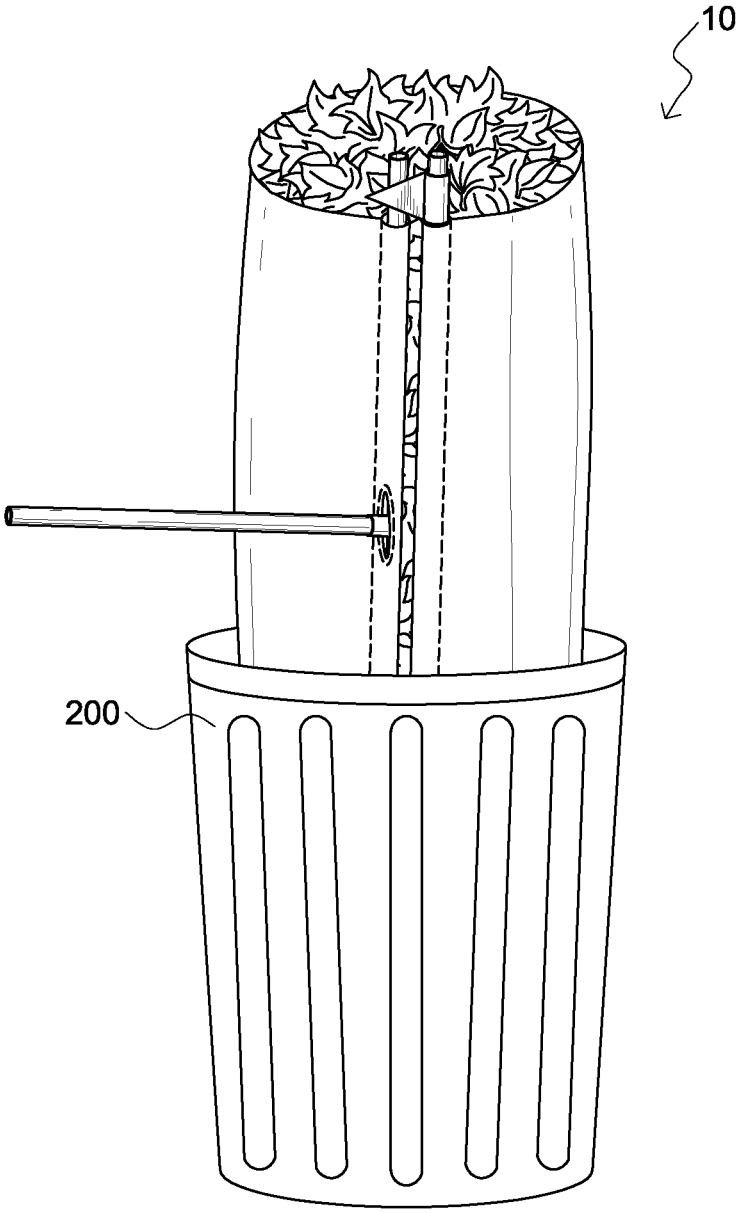

As shown in FIG. 4*e*, one of the open ends of the bundle is deposited over or in a trash receptacle 200 to allow the leaves to fall into the receptacle. To facilitate the release of the leaves, the user can shake the device, push on the fabric side, and separate the adjacent edges to encourage the leaves to exit the device.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. For instance, the exact design and configuration of the apparatus can vary dramatically from the illustrated embodiment utilizing different materials and mechanisms as best adapted for the materials and construction of the apparatus.

I claim:

1. A method of picking up leaves from a pile, the method comprising:

providing a leaf lifting device, the device comprising, a flexible rectangular sheet having left, right, top, and bottom edges, a right elongated rod, the elongated rod extending at least a substantial portion of a length of and being coupled to the right edge, a left elongated rod assembly, the left elongated rod assembly extending at least a substantial portion of a length of and being coupled to the left edge, and an elongated handle, a distal end of the elongated handle being coupled to the left elongated rod assembly proximate a longitudinal midpoint of the left elongated rod assembly with the elongated handle extending generally orthogonally outwardly from the left elongated rod assembly;

placing the device over a pile of leaves;

moving the left elongated rod assembly into the pile of leave and towards the right elongated rod by holding the elongated handle and pushing the left elongated rod assembly towards the right elongated rod using the elongated handle until the elongated rods are generally adjacent;

lifting and rotating the device containing leaves until the adjacent elongated rods are facing upwardly; and transporting the leaves to a location of disposal.

2. The method of claim 1 further comprising:

tilting the device containing leaves generally vertically while placing an open end formed by the bottom edge over a trash receptacle;

emptying the leaves into the receptacle through the open end.

3. The method of claim 1, further comprising:

removing the elongated handle from the leaf lifting device;

placing the handle generally parallel and adjacent to one of the left and right elongated rods; and rolling up the leaf lifting device for storage.

4. The method of claim 1, wherein the leaf lifting device further includes one or more stakes secured to the right elongated rod, and further comprises securing the one or more stakes in the ground.

5. A device for lifting and carrying leaves, the device comprising:

a flexible rectangular sheet having left, right, top, and bottom edges;

a right elongated rod, the elongated rod comprising PVC tubing and extending at least a substantial portion of a length of and being couple to the right edge;

a left elongated rod assembly, the left elongated rod assembly comprising a first piece of PVC tubing, a second piece of PVC tubing and a T-connector with respective ends of the first and second pieces being received in the T-connector, the left elongated rod assembly extending at least a substantial portion of a length of and being couple to the left edge;

an elongated handle comprising PVC tubing, a distal end of the elongated handle being coupled to the T-connector, and the elongated handle extending generally orthogonally outwardly from the left elongated rod assembly; and first and second ground stakes, the first stake being coupled to a first end of the right elongated rod and the second stake being coupled to a second end of the right elongated rod;

wherein (i) the right and left edges comprise respective right and left tubular sleeves, the right tubular sleeve having the right elongated rod received therein, and the left tubular sleeve having the left elongated rod assembly received therein with a handle opening being provided in the left tubular sleeve proximate a longitudinal midpoint thereof, the elongated handle proximate the distal end extending through the handle opening, and wherein the first and second stakes each include a cylindrical portion, the cylindrical portion being received over one of the first and second ends of the right elongated rod.

* * * * *